US011692403B2

(12) United States Patent
Klein et al.

(10) Patent No.: US 11,692,403 B2
(45) Date of Patent: Jul. 4, 2023

(54) ROD SECTION OF A GROUND DRILLING ROD

(71) Applicant: TRACTO-TECHNIK GmbH & Co. KG, Lennestadt (DE)

(72) Inventors: Tobias Klein, Lennestadt (DE); Andreas Joachim Hanses, Lennestadt (DE); Dieter Wurm, Kirchhundem (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 17/467,172

(22) Filed: Sep. 3, 2021

(65) Prior Publication Data

US 2022/0090452 A1 Mar. 24, 2022

(30) Foreign Application Priority Data

Sep. 18, 2020 (DE) ..... 10 2020 005 727.6

(51) Int. Cl.

| | |
|---|---|
| ***E21B 17/046*** | (2006.01) |
| ***E21B 1/00*** | (2006.01) |
| ***E21B 7/04*** | (2006.01) |

(52) U.S. Cl.

CPC ..... *E21B 17/046* (2013.01); *E21B 1/00* (2013.01); *E21B 7/046* (2013.01)

(58) Field of Classification Search

CPC ..... E21B 17/046; E21B 1/00

See application file for complete search history.

(56) References Cited

U.S. PATENT DOCUMENTS

| | | | | |
|---|---|---|---|---|
| 4,632,195 | A | 12/1986 | Emmerich | |
| 6,367,567 | B1 | 4/2002 | Massa et al. | |
| 10,556,275 | B2 * | 2/2020 | Hinshaw | B23B 31/117 |
| 11,149,501 | B2 * | 10/2021 | Smith | E21B 7/046 |
| 2018/0100538 | A1 * | 4/2018 | Hyson | F16D 1/064 |
| 2018/0169841 | A1 | 6/2018 | Hinshaw et al. | |
| 2022/0349264 | A1 | 11/2022 | Boike et al. | |

FOREIGN PATENT DOCUMENTS

| | | | |
|---|---|---|---|
| CN | 111188581 | A | 5/2020 |
| CN | 211715070 | U | 10/2020 |
| DE | 60025395 | T2 | 9/2006 |
| FR | 2634515 | A1 | 1/1990 |
| WO | 01/44616 | A1 | 6/2001 |

* cited by examiner

*Primary Examiner* — Jonathan Malikasim

(74) *Attorney, Agent, or Firm* — Leason Ellis LLP

(57) ABSTRACT

A rod section of a ground drilling rod configured at its end to form at least one plug connection and having at one end (a) a connecting plug with an outer contour; or (b) a connecting socket with an inner contour, the outer contour or the inner contour being essentially sinusoidal in cross section.

12 Claims, 3 Drawing Sheets

ROD SECTION OF A GROUND DRILLING ROD

FIELD OF INVENTION

The invention relates to a rod section of a ground drilling rod, a drive element for impact driving a ground drilling rod into the soil, a rod section system, and a ground drilling device.

BACKGROUND

For soil drilling operations that use a drill rod, in particular for the creation of so-called horizontal drill holes, which can run essentially parallel or at a relatively small angle to the earth's surface, a drilling head is advanced via a drill rod by a driving device that is located on the earth's surface or in an excavation pit. The drill rods used in this process usually consist of individual rod sections that are connected to each other, which, corresponding to the drilling progress, are brought in and connected one by one to the rear end of the drill rod that has already been drilled.

Various designs are known for connecting the rod sections to each other. The rod sections can be connected by means of a threaded connection and/or a plug connection.

It is established by DE 10 2011 010 958 A1 that the possibility exists to connect two rod sections of a drill rod in a manner that combines the advantages of the threaded connections known from the prior art and the axial plug connections. A plug connection is described therein that, like a threaded connection, is based on spiral projections/grooves that run circularly in the cross section on a threaded plug or in a corresponding threaded socket, the projections/grooves being designed in such a way that the characteristic self-locking of a threaded connection does not occur.

SUMMARY

Based on this prior art, the invention was based on the task of providing an improved design of a plug connection for a ground drilling rod, in particular of a component of the plug connection on a rod section and/or on a drive element, which in particular is of simpler design, can be handled more easily, and/or can be constructed more easily, whereby in addition or alternatively, a higher load in relation to the diameter can be achieved.

This object is achieved through the subject matter of the independent claims. A drive element designed to impact drive a ground drilling rod into the soil and to engage with a rod section. A rod section system and a ground drilling device are disclosed. Advantageous embodiments of the rod section, the drive element, the rod section system, and the ground drilling device are the subject matter of the respective dependent patent claims and/or result from the following description of the invention.

The invention is based on the idea of providing a possibility for connecting two rod sections of a drill rod and/or a rod section with a drive element and/or a further element of the drill rod, the connecting components having a contour that is sinusoidal in cross section (i.e., an outer contour for a connecting plug or an inner contour for a connecting socket). This makes it possible to form a section of the contour, in particular between a crest and an adjacent trough, with a different position or shape from that on the mating element of the plug connection. The formation of crests and troughs allows for sections to be designed as contact surfaces due to the resulting level differences. In this context, it is noted that although there is a line of contact within the cross section, the extension in the longitudinal direction of the cross section can be regarded as forming a contact surface, particularly if the contour extends over an area in the longitudinal direction. In particular, the transitions between the levels allows for a section to be formed that can be used for transmission of a torque. Such a configuration of a contour cross section is easy to design and manufacture. In addition, such a configuration enables surface pressure under torque to be greatly reduced so that axial movement between the connecting plug and the connecting socket is easily achievable even under this load, which can lead to simplified handling. Reduced surface pressure can ensure low wear on the plug connection. In addition or alternatively, a geometry optimized for torsional strength can accept high torque even in the area of the connector that is free as a result of the length tolerance (i.e., the part of the connecting plug that is not located in the connecting socket due to the resulting and/or necessary tolerances). The displacement force required to transmit the desired torque can be lower for the same cross-sectional area compared to other plug connections. In addition, the plug connection can have a significant notch effect compared to conventional splined wave/hub connections, since the plug connection can allow for large radii, and forces that occur can be introduced at a favorable, flat angle (much smaller than 90°). In accordance with the invention, it was recognized that none of the above advantages could be achieved in this way with technically similar wave/hub connections.

The invention provides a rod section of a ground drilling rod, wherein the rod section is designed to form at least one plug connection at the end. At one end of the rod section is (a) a connecting plug with an outer contour or (b) a connecting socket with an inner contour. The outer contour or the inner contour is essentially sinusoidal in cross section.

The term "rod section" in the context of the invention comprises an element extending along a longitudinal axis that can be part of a ground drilling rod or a drill string for soil. The rod section can be designed as an element located at the front of the drill string with an assigned function (transmission housing, drilling tool, or similar) or as an element that merely constitutes an extension of the drill string as a "normal" rod section. The rod section can comprise mechanical channels for, for example, drilling fluid, electrical conductors, electrical components, and/or electronic components. The rod section can have a special function in the ground drilling rod (e.g., it can be designed as a transmission housing).

A rod section can have a first end with a connecting plug or connecting socket as described. The rod section can further include a second end a distance from the first end, which typically exhibits the other element of the plug connection pair. The rod section can further exhibit a centerline extending from the first end to the second end. The cross section of a given connecting plug or connecting socket can in particular be a cross section perpendicular to the centerline of the rod section.

The rod section described here in the context of the description can in particular be a dual tube rod section in which both an inner rod and an outer rod are present. In such a dual tube rod, a drilling head can additionally be driven to rotate via the inner rod by the driving device located at the earth's surface or in an excavation pit, the driving device also serving to advance the drilling head. For this purpose, the inner rod can be located inside the outer rod of the dual tube rod, mounted in such a way that it can be rotated. In the case of a dual tube rod, the outer rod must either not be rotated at all or be rotated only at a low speed. The rotation of the outer rod and inner rod can occur independently of each other. A dual tube rod is particularly suitable for a rock drill, wherein the wear of the drill rod is kept within limits, because the outer tube, which is in contact with the rocky borehole wall, can be advanced along the rocky borehole wall without rotation or only at a low speed while the inner rod, which is driven at a higher speed, can be mounted inside the outer rod to reduce wear. Particularly, an embodiment such as that described for a connecting plug or for a connecting socket can be elected for at least one, particularly all, of the inner rod sections of the dual tube rod. Two inner rod sections can thus be connected by means of a plug connection per the description. A different type of connection can be selected for the outer rod or outer rod section within which the respective inner rod section is located; in particular, the outer rod section can be bolted to an adjacent outer rod section. In particular, an inner rod section can be mounted in an outer rod section such that it is axially movable.

The term "ground drilling tool" comprises a drilling head at the front end of the ground drilling rod or drill string, possibly inclusive of movable components. It can also be stipulated, though, that the ground drilling tool have an immovable or rigid, or mostly immovable or rigid, outer contour.

In the context of the description, the term "ground drilling device" comprises any device that in particular moves a rod consisting of rod sections in an existing passage in the soil, or in one that is to be created, to create or widen a borehole, particularly a horizontal drill hole, or to pull pipelines or other long bodies into the soil. A ground drilling device can comprise a driving device that pulls and/or pushes a ground drilling rod. It can additionally or alternatively be intended that the driving device rotationally drives the drill rods.

The term "horizontal drilling" in the context of the description comprises in particular any type of passage in a body, existing or to be created, preferably horizontal, particularly earth passages including earth boreholes, rock boreholes, or earth conduits as well as underground or above ground pipelines and water channels, that can be constructed or pulled in by using an appropriate ground drilling device.

In the context of the description, the terms "connecting plug" and "connecting socket" denote an embodiment as one member of a pair of mechanical coupling elements, one of which (connecting plug) can be inserted at least partially into the other (connecting socket) to form the connection.

The term "sinusoidal" in the context of the description comprises a waveform that has (wave) crests and (wave) troughs. The waveform essentially follows the outer or inner perimeter of the outer or inner contour. The sinusoidal shape is closed with respect to the cross section. The waveform can thus result from a circular shape in a plane transverse to the longitudinal extension of the rod section, wherein the circular shape can be related to, for example, the direction of propagation of a wave. A sine wave is possible for the inner contour or the outer contour. Deviations from a precise sine wave are possible, and deviations from the sine wave resulting from the description are possible. In addition to the modifications specifically mentioned in the description, a sine wave also comprises an undulating design that is inclusive of slight deviations caused, for example, by manufacturing technology.

The term "sinusoidal" can be used in the same denotative way to mean that the outer contour or inner contour has inwardly curved (concave) sections and outwardly curved (convex) sections. In this respect, the term "sinusoidal" can substituted by the concept that the outer contour or the inner contour has outwardly curved sections and inwardly curved sections in cross section. The curvature of the sections can deviate from a sinusoidal design, in particular according to the embodiment defined in the description.

In a preferred embodiment, the outer contour has arc-shaped inwardly curved sections, and the inner contour has arc-shaped outwardly curved sections. The wave trough of the connecting plug or the wave crest of the connecting socket is designed as an arc or as part of an arc in deviation from the sinusoidal shape. This essentially constitutes a segment of a circle, wherein the term "arc-shaped" can also involve deviations from the circular shape in terms of a standing or lying ellipse or a flattening of the circular shape. Such an embodiment allows for some advantages mentioned in relation to the object to be at least somewhat easily implemented and efficiently achieved.

In a preferred embodiment, the outer contour has outwardly curved arc-shaped sections and the inner contour has inwardly curved arc-shaped sections, respectively. That is, the wave crests of the outer contour and the wave troughs of the inner contour each have an arc shape, thereby enabling simple manufacture of the connecting plug or connecting socket.

In a preferred embodiment, the outer contour of the connecting plug or the inner contour of the connecting socket has a number of inwardly curved or outwardly curved sections in cross section totaling two, three, four, five, or more, although an even number may be preferred. Particularly preferably, the number of inwardly curved sections in the cross section of the connecting plug is greater than or equal to six. Particularly preferably, the number of outwardly curved sections in the cross section of the connecting socket is greater than or equal to six. The number of outwardly or inwardly curved sections in the cross section of the outer contour of the connecting plug or the inner contour of the connecting socket can be two, three, four, five, or more. Particularly preferably, the number of inwardly curved sections in the cross section of the connecting socket is greater than or equal to six. Particularly preferably, the number of outwardly curved sections in the cross section of the connecting plug is greater than or equal to six. The number of curved sections that are curved inward and the number of curved sections that are curved outward is preferably the same for the inner contour of the connecting socket and for the outer contour of the connecting plug. This allows a symmetrical cross section to be achieved. In a preferred embodiment, the difference between the inner and outer diameters can be varied. In particular, the difference between the inner and outer diameters can be increased, whereby larger contact surfaces and consequently lower surface pressures can be achieved.

In a preferred embodiment, the arc-shaped inwardly curved sections of the outer contour have a radius R1, and the arc-shaped outwardly curved sections of the inner contour have a radius R1', and/or the arc-shaped outwardly curved sections of the outer contour have a radius R2, and the arc-shaped inwardly curved sections of the inner contour have a radius R2'. This makes it easy to efficiently manufacture the embodiment. In a preferred embodiment, the respective sections of the inner contour and/or the outer contour with the same curvature all have the same radius. Appropriate design of the sections connecting the curved sections allows for a symmetrical inner contour for the connecting socket and/or a symmetrical outer contour for the connecting plug. It can be stipulated that the radii for the outwardly curved sections and the inwardly curved sections of the inner contour are the same, so that R1'=R2'.

For ease of insertion and/or design of the connecting sections as straight lines, each of which in particular can interact with another straight line on the other member, the outwardly curved section of the outer contour can have a smaller radius than the outwardly curved section of the inner contour. Similarly, the inwardly curved section of the outer contour can have a larger radius than the inwardly curved section of the inner contour. For example, the inner contour can be designed such that all radii of the inner contour are the same. For example, the radius of the sections can be in the range of 4.5 mm to 6 mm, in particular from 4.5 mm to 5.5 mm, very particularly preferably 5.1 mm, which can be in the range of 15% to 20%, very particularly preferably 17%, or slightly less than ⅙ of, the mean diameter of contours of, for example, about 30 mm.

The outwardly curved section of the outer contour can have a radius in the range of 3.5 mm to 5.5 mm, in particular from 4 mm to 5 mm, very particularly preferably 4.5 mm, which can be in the range of 10% to 20%, very particularly preferably 15%, or slightly less than 1/6.67, of the mean diameter of contours of about 30 mm. The radius of the inwardly curved section of the outer contour can be in the range of 4.5 mm to 6.5 mm, particularly preferably 5 mm to 6 mm, and can very particularly preferably be 5.3 mm, which can be 15% to 20%, very particularly preferably 17.67%, or 1/5.66, of the mean diameter of contours of about 30 mm.

In a preferred embodiment, the outer contour or the inner contour has straight lines that can particularly be formed continuous with an outwardly curved section or an inwardly curved section. In particular, a straight line can connect an inwardly curved section to an adjacent outwardly curved section. A straight line enables a simple and efficient design, although other embodiments are also possible. In particular, the design of a straight line enables a simple design for the manufacture of a contact surface. The formations designed as straight lines (in cross section) or as surfaces (along the longitudinal direction) for interaction with a corresponding formation embodied on the other plug member offer the possibility of large flat areas, whose orientation and position in space are simple from a design perspective and can be easily manufactured.

In a preferred embodiment, the outer contour or the inner contour is essentially symmetrical with respect to a center axis or two center axes perpendicular to each other. This enables particularly simple design of the geometry. A simple design is possible, inclusive of deviations in symmetry caused by manufacturing.

In a preferred embodiment, in order to increase the contact surface area, it is stipulated that the sinusoidal design of the inner contour or of the outer contour extend over a length of 10 mm to 120 mm, particularly preferably 20 mm to 120 mm, particularly preferably 30 mm to 110 mm, particularly preferably 40 mm to 100 mm, very particularly preferably 40 mm to 90 mm, very particularly preferably 50 mm to 90 mm, in the longitudinal extension of the rod section, wherein the design of the cross section in the longitudinal extension of the rod section can be similar or identical, particularly over the entire aforementioned length.

In a preferred embodiment, the rod section has a chamfer at the end, which can function as an insertion chamfer. An insertion chamfer can simplify the design of the plug connection in that the contours of the connecting plug and connecting socket are essentially congruent, allowing the connecting plug to slip into the connecting socket. The connecting socket can initially slide onto the connecting plug until, for example, the outer tube of a dual tube rod is screwed on.

The invention also establishes a drive element for impact driving a ground drilling rod into the soil. The drive element is designed to engage with a rod section. The drive element is designed as a connecting plug or a connecting socket. The connecting plug has an outer contour, or the connecting socket has an inner contour, that is sinusoidal in cross section.

This makes it possible to use a drive element of a driving device that is tailored to the special geometry of the rod sections, whereby a high torque for the diameter can be transmitted. Surface contact between the drive element and the rod section, and thus a significantly reduced surface pressure, can be achieved.

The term "drive element" in the context of the description comprises a component of a driving device that can advance a ground drilling rod in the soil, wherein the drive can be designed in particular as a pushing and/or pulling drive, wherein the driving device can additionally be designed to rotate the ground drilling rod. The drive element can be a component on a carriage. The carriage can be moved back and forth in/on a frame, in particular parallel to the direction of the earth borehole to be created.

The invention also provides a rod section system comprising two or more rod sections of the prescribed embodiment.

In a preferred embodiment, the connecting socket has a different shape than the connecting plug, which can in particular apply to the region of the cross section that can connect a wave crest to an adjacent wave trough. In the case of a straight line connecting the outwardly curved section (wave crest) to an adjacent inwardly curved section (wave trough) of the contour, an angle can be selected, for example, for the straight line of one of the two plug members that can be different from the angle of the straight line of the other of the two plug members with which the straight line can come in contact. In particular, the sections between the wave crest and wave trough, which are designed as straight lines, can be used for contact between the two plug members, which can lead to a simplified manufacture of the plug members. In particular, the angle of a straight line for the contour of the connecting socket can be smaller relative to a centerline or center axis of the cross section than the angle of a straight line for the contour of the connecting plug relative to the centerline. There can be relative rotation between the connecting plug and connecting socket, wherein the angle resulting from subtracting the two angles of the straight lines is preferably in the range of a few degrees, particularly in the range of 1° to 10°, particularly from 1° to 5°, particularly from 1° to 4°, particularly 1° to 3°, particularly 1.5° to 2.5°.

It can be stipulated that the angle of a straight line of the cross section of the connecting plug relative to the centerline of the cross section to either side of a wave crest can be in the range of 30° to 60°, preferably 40° to 55°, preferably 40° to 50°. The angle of a straight line of the connecting socket to either side of a wave trough can be in the range of 30° to 60°, preferably 40° to 55°, preferably 40° to 50°. The difference of the angles to each other can be in the range of a few degrees, particularly 1° to 10°, particularly 1° to 8°, particularly 1° to 7°, particularly 1° to 6°, particularly 1° to 5°, particularly 1° to 4°, particularly 1° to 3°, particularly 2°. In a particularly preferred embodiment, a straight line of the connecting plug on either side of a wave crest forms an angle of about 45° to the centerline of the cross section, and a straight line of the connecting socket on either side of a wave trough can form an angle of about 43° to the centerline of the cross section. The difference between the connecting plug and the connecting socket can be about 2° in both directions of rotation. The term "centerline" constitutes a line related to the cross section of a plug member. The centerline can pass through the center of the cross section and coincide with a radius. In particular, the centerline can be a line that passes through the center of the cross section and the maximum or minimum of an adjacent wave trough or wave crest of a given straight line.

Further, the invention comprises a ground drilling device comprising a drive element of the prescribed embodiment.

The statements in the description regarding the possible embodiment of the rod section also apply to a possible embodiment of the drive element. Accordingly, the explanations and description regarding the rod section supplement the explanations regarding the drive element.

Numerical values in the context of the description are values that can be subject to a tolerance of +/−10%, in particular +/−5%, so the numerical values do not specify only the one indicated value, but rather constitute a range of values, particularly to account for tolerance ranges that could result from the manufacturing process.

Neither the preceding information nor the following description of an exemplary embodiment constitutes a waiver of any particular embodiments or features.

BRIEF DESCRIPTION OF DRAWINGS

The invention is clarified below with reference to the exemplary embodiment shown in the figures.

The figures show.

DETAILED DESCRIPTION

Figure 1:
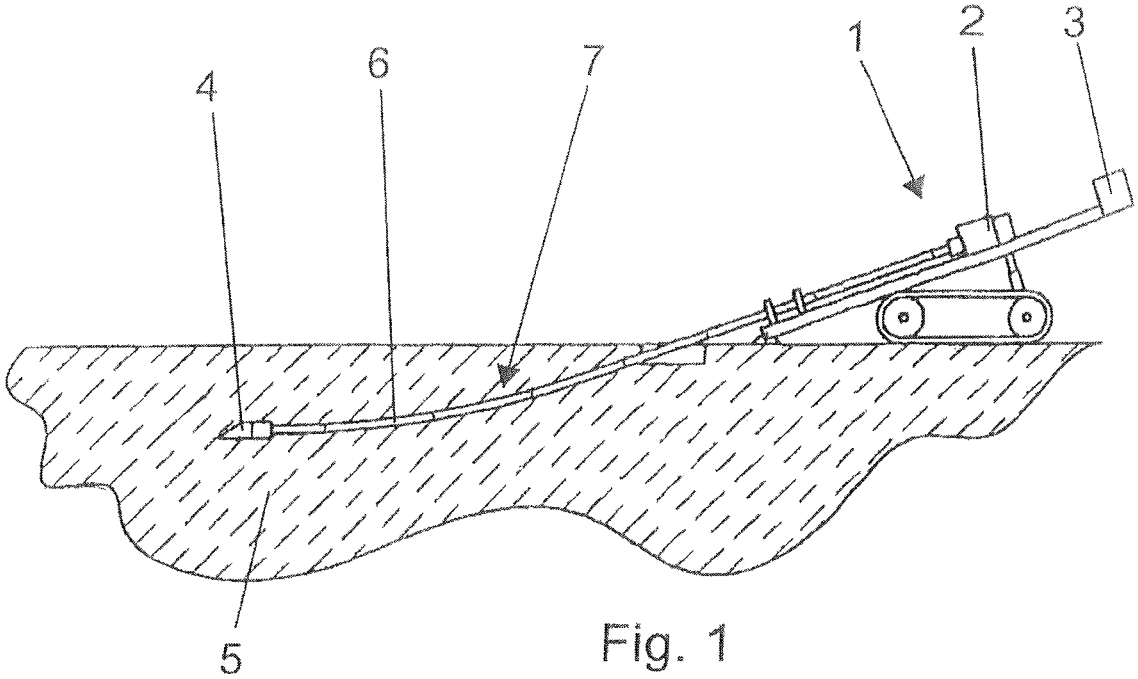
FIG. 1 a schematic view of a ground drilling device with a drill rod.

FIG. 1 shows a schematic of a ground drilling device 1 for trenchless laying of lines such as water, wastewater, power, or data lines during pilot borehole creation. The ground drilling device 1 is equipped with a rotary drive 2 and a feed drive 3 to move a drilling head 4 or a reaming tool, which is not shown, forward or backward through the soil 5.

The drilling head 4, which is designed asymmetrically for executing controlled drilling paths, is located at a front end of a drill string 7, which is composed of individual drill rod sections 6.

Figure 2:
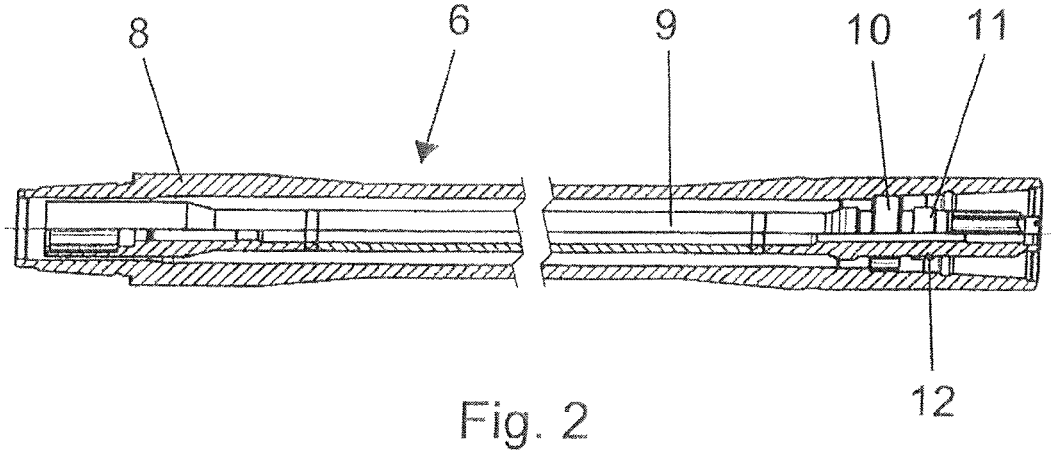
FIG. 2 a schematic view of a section of a ground drilling rod, in particular a rod section in a sectional view from the side.

FIG. 2 shows a drill rod section 6, or rod section, in the form of a dual tube rod section. The drill rod section 6 has an outer tube 8, or an (outer) rod section. The outer tube 8 has a conical external thread at one end and a conical internal thread at the other end, so that at the ends, two outer tubes 8 of a drill rod section 6 can be screwed together. Within the outer tube 8 of a drill rod section 6 or a dual tube rod section, an inner tube 9, or (inner) rod section, is mounted such that it is movable. The inner tube 9 is fixed to the outer tube 8, the inner tube 9 being fixed in the outer tube 8 by means of a threaded ring 10 screwed into the outer tube 8. The inner tube 9 is accepted by the threaded ring 10 such that it can move longitudinally. To secure the inner tube 9 against sliding out of the outer tube 8, a stop ring 11 is slid onto the inner tube 9. The stop ring 11 is secured against axial displacement by a retaining ring 12.

Figure 3:
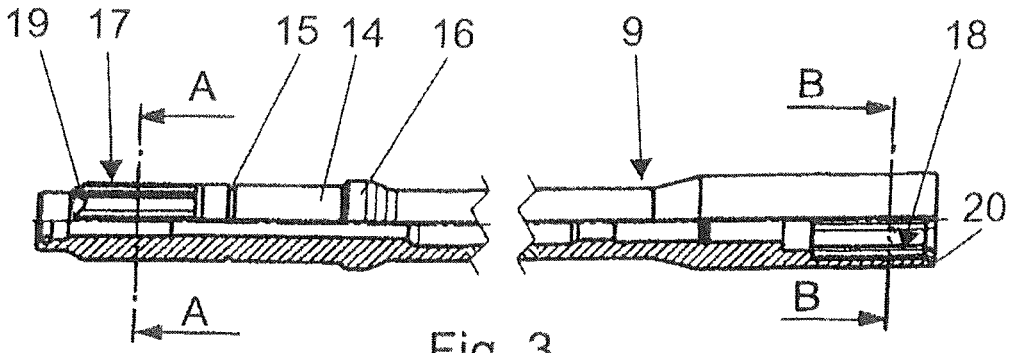
FIG. 3 an (inner) rod section of a dual tube rod.

FIG. 3 shows an inner tube 9 as removed from the system (i.e., without the outer tube 8 of the dual tube rod section 6). The inner tube 9 has a bore 13 for the passage of drilling fluid, through which data or other energy lines (not shown) can also be passed. In order to ensure axial play of the inner tube 9 in the outer tube 8, each inner tube 9 has a sliding surface 14, which ends with a groove 15 for the retaining ring 12. On the side of the sliding surface 14 opposite the groove 15, there is a stop edge 16 to limit the axial movement of the inner tube 9 relative to the outer tube 8. The connection of the inner tubes 9 is designed as a plug connection, wherein they slide onto one other when the outer tubes 8 are screwed together.

Figure 4:
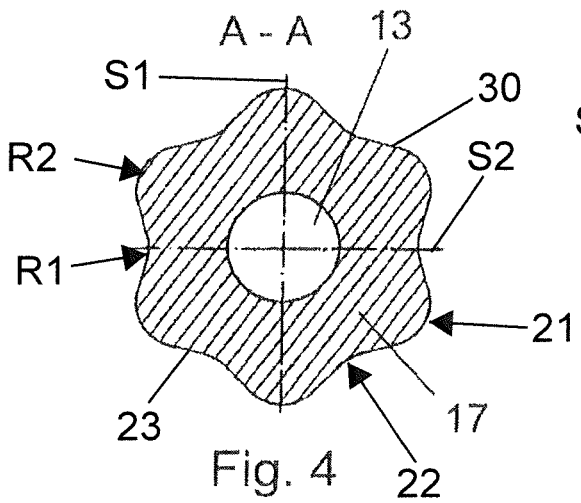
FIG. 4 a cross section A-A through a connecting plug of the rod section according to FIG. 3.
Figure 5:
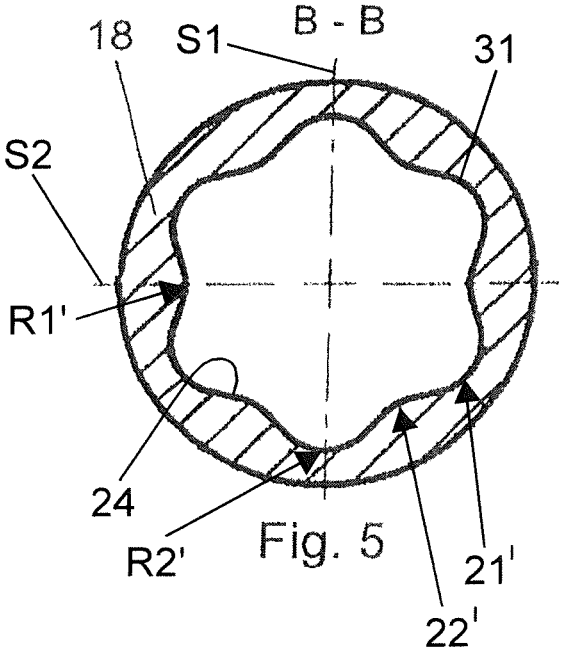
FIG. 5 a cross section B-B through a connecting socket of the rod section according to FIG. 3.

FIG. 4 shows a section A-A through a connecting plug 17 of the inner tube 9 of FIG. 3. FIG. 4 shows the outer contour 30 of the connecting plug 17 in cross section. FIG. 5 shows the inner contour 31 of the connecting socket 18 in cross section.

Figure 6:
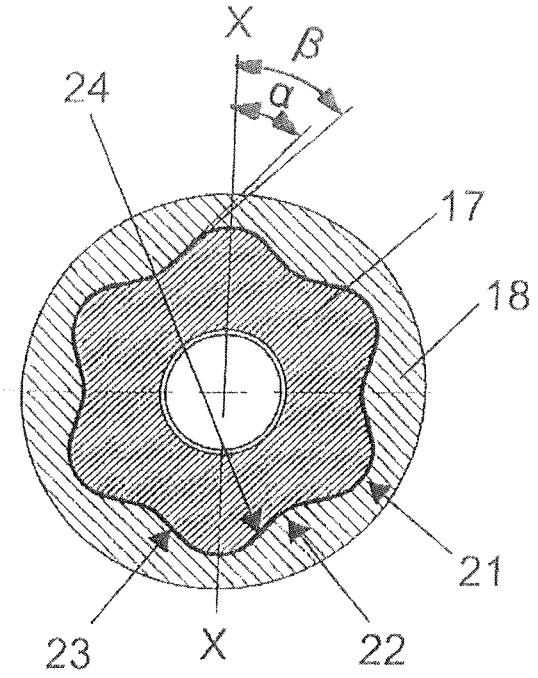
FIG. 6 a cross section through a connected plug connection of a connecting socket and a connecting plug, not under torque.
Figure 7:
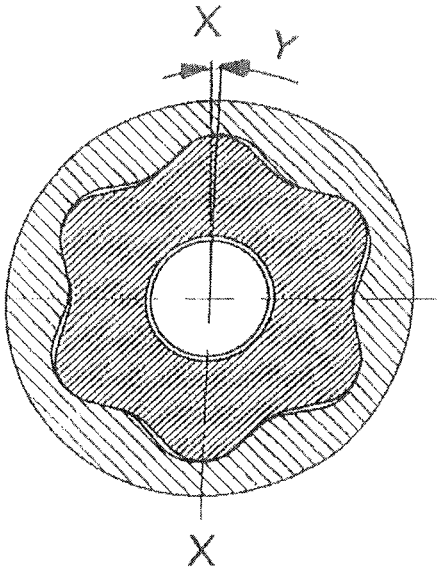
FIG. 7 a cross section through a connected plug connection of a connecting socket and a connecting plug, under torque.

FIG. 5 shows a section B-B through a connecting socket 18 of an inner tube 9 according to FIG. 3. The outer and inner contours 30, 31 in the cross section of connecting plug 17 and connecting socket 18 are shown in FIGS. 6 and 7 as a section of two connected inner tubes 9. The connection thereby of two adjacent drill rod sections 6 occurs as follows: Outer tubes 8 and inner tubes 9 of a dual tube rod section 6 to be newly connected are rotated independently of each other by the rotary drive 2 (in this case a double rotary drive). Now this new dual tube rod section 6 is brought up to another dual tube rod section 6 located in front of it. The plug connection of the inner tubes 9 has a (insertion) chamfer 19, 20 on both the connecting plug 17 and on the connecting socket 18. As soon as the inner contour 31 of the connecting socket 18 of an inner tube 9 that has been set in rotation is more or less aligned with the outer contour 30 of a connecting plug 17 of an adjacent or front inner tube 9, the inner tube 9 that is in the rear or to be connected slips into the inner tube 9 in front of it, which now rotates with it. During continued screwing of the outer tubes 8, the connecting socket 18 slides further onto the connecting plug 17 until the screwing process of the outer tubes 8 is completed. To compensate for length tolerances in the inner tubes 9 and the outer tubes 8, the inner tubes 9 are axially movable in the threaded rings 10 via sliding surfaces 14.

FIGS. 4 to 7 show in detail a possible embodiment of the outer contour 30 of the cross section of the connecting plug 17 or the inner contour 31 of the cross section of the connecting socket 18.

FIG. 6 shows a section through the connected plug connection without torque load. The outer contour 30 of the connecting plug 17 and the inner contour 31 of the connecting socket 18 are composed of inwardly and outwardly curved sections 21, 22 and of inwardly and outwardly curved sections 21', 22'. The outwardly curved sections 22' of the inner contour 31 have a radius R1' and the inwardly curved sections 21' of the inner contour 31 have a radius R2'. The inwardly curved sections 22 of the outer contour 30 have a radius R1 and the outwardly curved sections 21 of the outer contour 30 have a radius R2. R1'=R2'; R2<R1' and R1>R1'.

Between an outwardly curved section 21 of the outer contour 30 and an adjacent inwardly curved section 22 of the outer contour 30, there is a section that is in the form of a straight line 23. The outer contour 30 has twice as many straight lines 23 as outwardly or inwardly curved sections 21, 22. Between an inwardly curved section 21' of the inner contour 31 and an adjacent outwardly curved section 22' of the inner contour 31, there is a section that is in the form of a straight line 24. The inner contour 31 has twice as many straight lines 24 as outwardly or inwardly curved sections 21', 22'.

In the no-torque condition, as shown in FIG. 6, connecting plug 17 and connecting socket 18 are more or less concentrically aligned, wherein there is a small amount of play between connecting plug 17 and connecting socket 18. The straight lines 23, 24 of the contours of connecting plug 17 and connecting socket 18 have different angles to the centerline X-X, or S1 (example shown). In addition to the centerline S1, the centerline S2 running perpendicular thereto is also illustrated.

The straight lines 23 of the connecting plug 17 are executed at the angle β to the centerline X-X. The straight lines 24 of the connecting socket 18 are executed at the angle α to the centerline X-X. Angle β is greater than angle α. All straight lines of the respective contours have a similar or identical design with respect to the angle to a corresponding center axis, which symmetrically divides a wave crest or wave trough.

When a torque is applied to the connecting socket 18 or to the connecting plug 17, as shown in FIG. 7, there is a relative rotation between the connecting socket 18 and the connecting plug 17 by the angle Y, wherein the angle Y is calculated by subtracting the angle α from the angle β: Y=β−α.

In the position shown in FIG. 7, the surfaces of straight lines 23, 24 of the connecting plug 17 and connecting socket 18 make contact, the loaded surfaces being based on the direction of rotation. Thus, the surface pressure between connecting plug 17 and connecting socket 18 is kept very low so that axial displacement between connecting plug 17 and connecting socket 18 is easily possible even under high torque. Due to the long lengths of the dual tube rod sections 6 (e.g., 3 to 6 m) and the associated length tolerances of the outer tubes 8 and the inner tubes 9 of the dual tube rod section 6, relative axial displacement of the inner tubes 9 with respect to each other is required. The positions as well as the lengths of the connecting plug 17 and connecting socket 18 are therefore designed appropriately.

The invention claimed is:

1. A rod section of a ground drilling rod,
the rod section comprising an end that is configured to form at least one plug connection and
wherein the end comprises
(a) a connecting plug having an outer contour; or
(b) a connecting socket having an inner contour;
wherein the outer contour or the inner contour is essentially sinusoidal in cross section,
wherein the outer contour and the inner contour have straight lines.

2. The rod section according to claim 1,
wherein the inner contour comprises arc-shaped inwardly and outwardly curved sections,
wherein the arc-shaped inwardly and outwardly curved sections have a radius,
wherein the outer contour comprises arc-shaped outwardly curved sections having a radius and arc-shaped inwardly curved sections having a radius,
wherein the radius of the arc-shaped inwardly and outwardly curved sections of the inner contour is larger than the radius of the arc-shaped outwardly curved sections of the outer contour and smaller than the radius of the inwardly curved sections of the outer contour.

3. The rod section according to claim 1, wherein the straight lines have an angle to a centerline (X-X) of the cross-section of the rod section that is the same for adjacent straight lines.

4. The rod section according to claim 1, wherein the outer contour or the inner contour extends over a length of 10 millimeters (mm) to 120 mm in longitudinal extension of the rod section.

5. The rod section according to one of claim 1, wherein the end of the rod section is a chamfered end.

6. The rod section according to claim 1, wherein the inner contour comprises arc-shaped outwardly curved sections.

7. The rod section according to claim 1, wherein the outer contour comprises arc-shaped outwardly curved sections.

8. The rod section according to claim 1, wherein the inner contour comprises arc-shaped inwardly curved sections.

9. The rod section according to claim 1, wherein the outer contour comprises arc-shaped inwardly curved sections.

10. A drive element for impact driving a ground drilling rod into the soil, wherein the drive element engages with a rod section and
wherein the rod section comprises an end that is configured
(a) as a connecting plug or
(b) as a connecting socket;
wherein the connecting plug has an outer contour in cross section or
the connecting socket has an inner contour in cross section,
wherein said outer contour cross section or said inner contour cross section are essentially sinusoidal,
wherein the outer contour cross section and the inner contour cross section have straight lines.

11. A rod section system of a ground drilling device, the rod section system comprising
two or more rod sections,
wherein at least one of the rod sections has a connecting plug comprising an outer contour in cross section, and
at least another one of the rod sections has a connecting socket comprising an inner contour in cross section, and
wherein each one of the outer contour and the inner contour are essentially sinusoidal in cross section and each having straight lines,
wherein an angle (β) of the straight line of the outer contour to a centerline (X-X) of the cross section is greater than an angle (α) of the straight line of the inner contour to the centerline (X-X) of the cross section.

12. A ground drilling device comprising the drive element according to claim 10.

* * * * *